US007208732B2

(12) United States Patent
Clayfield et al.

(10) Patent No.: US 7,208,732 B2
(45) Date of Patent: Apr. 24, 2007

(54) STRUCTURE FOR ATTACHING WIRE ASSEMBLY TO A DICOR HOUSING

(76) Inventors: Jamie S. Clayfield, 9 Waterford Cr., Rochester, NY (US) 14618; S. Chad Velk, 76 Gold St., Rochester, NY (US) 14620

( * ) Notice: Subject to any disclaimer, the term of this patent is extended or adjusted under 35 U.S.C. 154(b) by 18 days.

(21) Appl. No.: 11/235,937

(22) Filed: Sep. 27, 2005

(65) Prior Publication Data

US 2007/0069130 A1 Mar. 29, 2007

(51) Int. Cl.
*H01T 19/04* (2006.01)

(52) U.S. Cl. ..... 250/324

(58) Field of Classification Search ..... 250/324, 250/325, 326; 361/230, 229, 226
See application file for complete search history.

(56) References Cited

U.S. PATENT DOCUMENTS 4,104,521 A * 8/1978 Herrmann et al. ..... 250/324
4,764,675 A * 8/1988 Levy et al. ..... 250/324
5,449,906 A * 9/1995 Osbourne ..... 250/324

* cited by examiner

*Primary Examiner*—Kiet T. Nguyen
(74) *Attorney, Agent, or Firm*—James J Ralabate

(57) ABSTRACT

A dicorotron unit and a wire assembly of a dicorotron unit where a wire electrode is strung between two insulator anchors. The anchors are held in place by flexible grippers. The grippers have flexible tabs that snap into the dicorotron housing and allow the grippers to remain in this housing when the wire assembly is removed from the dicorotron unit.

11 Claims, 3 Drawing Sheets

STRUCTURE FOR ATTACHING WIRE ASSEMBLY TO A DICOR HOUSING

CROSS REFERENCE

Illustrated and disclosed in co-pending applications Ser. Nos. 11/235,935 and 11/235,936 all owned by the present assignee. These are applications relating to dicorotrons used in an electrostatic process. These two applications and the present application are filed concurrently herewith. The disclosures of these two above-noted applications are totally incorporated herein by reference.

In application Ser. No. 11/235,935 concurrently filed herewith a dicorotron wire assembly and removal tool is disclosed and claimed. In application Ser. No. 11/235,935 a tool is used to both remove and insert a wire assembly from and into a U-shaped dicorotron unit. When an empty tool removes a faulty wire assembly from the dicorotron unit, remaining is an empty dicorotron unit devoid of a wire assembly. This empty dicorotron unit is then supplied a new wire assembly by the duplicate tool loaded with this new wire assembly. The loaded tool in a deposit step deposits a wire assembly in the dicorotron now leaving an empty tool. This empty tool is then used in a removal step to remove a faulty wire assembly from a second dicorotron unit, etc.

In application Ser. No. 11/235,936 concurrently filed herewith a dicorotron wire assembly removal and storage tool is disclosed and claimed. In application Ser. No. 11/235,936 a storage box is provided having a removal tool mounted on its top portion. The removal tool is situated above an opening in the box through which a removed wire assembly will fall after being removed from the dicorotron unit. The box provides a storage and collection bin for all of the removed faulty wire assemblies.

The present invention relates to electrostatic processes and more specifically to a dicorotron unit and a novel corona wire assembly.

BACKGROUND

In Xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attached to the latent electrostatic image areas to create a visible replica of the original. The developed image is then usually transferred from the photoreceptor surface to a final support material, such as paper, and the toner image is fixed thereto to form a permanent record corresponding to the original.

In some Xerographic copiers or printers, a photoreceptor surface is generally arranged to move in an endless path through the various processing stations of the xerographic process. When the photoreceptor surface is reusable, the toner image is then transferred to a final support material, such as paper, and the surface of the photoreceptor is prepared to be used once again for the reproduction of a copy of an original. In this endless path, several stations of corona charging are traversed. These charging stations may involve one or a cluster of dicorotron units.

Several methods are known for applying an electrostatic charge to the photosensitive member such as the use of electron-emitting pins, an electron-emitting grid single corona-charging structures and multiple dicorotron wire assemblies. In recent development of high speed xerographic reproduction machines where copiers can produce at a rate of or in excess of three thousand copies per hour, the need for several reliable dicorotron wire assemblies in order to utilize the full capabilities of the reproduction system are required. Also, with the advent of color copiers where several corona-charging stations are needed, the requirement for dependable dicorotron wire assemblies for depositing an electrostatic charge is essential.

Generally, in electrostatographic or electrostatic copy processes, as above noted, a number of corotrons or dicorotrons are used at various stations around the photoreceptor. For example, the dicorotrons are used at the station that places a uniform charge on the photoreceptor, at a transfer station, at a cleaning station, etc. In today's high speed copiers, it is important that all corotrons (or dicorotrons) are in perfect working order since corotron malfunction can easily render the entire copying process useless. Some high speed copiers, including color copiers, use several dicorotron units, as many as sixteen corotron or dicorotron units are used. Maintaining each corotron unit in perfect working order is essential to the proper functioning of these complex fast color copiers. It is common to use one or several corona-generating device(s) ("corotron" "dicor" or "dicorotron") for depositing the electrostatic charge at the above-noted stations. Generally, the structure of a dicorotron uses a thin, glass-coated wire mounted between two insulating anchors or end blocks called "insulators or anchors", which support the wire in a spring tensioned manner in a singular plane. "Anchor(s)" throughout this disclosure and claims will include the terms "insulators", "insulator anchors" and "insulator". "Gripper(s)" throughout this disclosure and claims will include the terms "holder" and "clamp". These insulators or anchors are installed between relatively rigid grippers or holders or clamps that maintain the insulators in place. These insulator gripper inserts are fixed at two opposite ends of a U-shaped dicorotron unit ("housing" or "shells"). The wire or corona-generating electrode is typically a highly conductive elongated wire situated in close proximity to the photoconductive surface to be charged. Often the corona discharge electrode is coated with a dielectric material, such as glass. Since the wire electrode is comprised of a thin outer glass brittle coating, it may be easily damaged. Some handling or cleaning of this electrode often results in fracture of the glass coating, which could cut or injure the user. While cleaning sometimes corrects problems in this corona electrode, it is sometimes necessary to replace the wire due to degradation in the corona performance or even in breakage of the electrode which could occur during the cleaning.

Manual handling of the glass-coated wire is not recommended nor is the use of prying tools, such as screw drivers or rigid prying objects. Extreme care needs to be observed in changing the corona electrodes or wires. As above noted, because of the large number of dicorotrons or wires needed in some copiers, malfunctioning of these wires presents a formidable problem in today's complex copiers.

Another important consideration is the high costs of dicorotron assemblies. The most expensive major component in the dicorotron unit or assembly is the housing or U-shaped shield which in the prior art houses the wire assembly comprised of the wire anchors (insulators), corona wire electrode and grippers. The least expensive major component in the dicorotron unit or assembly is the wire assembly. It makes sense, therefore, for the faulty wire assembly to be removed and replaced rather than the expensive entire dicorotron unit made up of the wire assembly and U-shaped housing.

There are some systems used to remove and replace wire electrodes from the U-shaped housing, such as the method disclosed in U.S. Pat. No. 5,449,906 (Osbourne). In this prior art system, the U-shaped housing has apertures on its end portions adjacent to the electrode anchors or insulators. A prying tool is then inserted into this aperture to pry or dislodge the two end insulators from their original position thereby removing the two insulators and the attached wire electrode. A tool for replacing the removed wire electrode in Osbourne's process includes a plurality of replacement electrodes mounted on a rigid support frame. Replacement is accomplished by pressing this support frame containing a plurality of corona-generating wire assemblies against the empty U-shaped housing (where old wire has been removed) and thereby replacing the removed wire electrode with a new wire electrode. This prior art process requires prying or dislodging the old wire through an aperture and replacing the old wire with a mounting system where a plurality of corona-generating electrode assemblies are removably mounted in a configuration matching that of the original configuration.

SUMMARY

In the prior art, the grippers are permanently attached to the anchors and must be pried loose when a faulty wire assembly is removed from a dicorotron unit. The grippers are fitted into the apertures in a dicorotron unit and are molded permanently (or otherwise fixed) to the anchors. Removing the faulty wire assembly requires dislodging the grippers from the apertures, thereby removing with the grippers the anchors and wire electrode. The wire assembly thus in the prior art is made up of primarily three components: (1) anchors which are connected by a (2) wire electrode, and by (3) grippers which are in effect part of the anchors. In the present embodiment, a gripper is used that has flexible upwardly extending supports that hold the anchors in position and prevent the anchors from rotating. Adjacent these supports are tabs which snap into apertures in the dicorotron housing. When the faulty wire assembly is removed, the grippers remain in the dicorotron housing and can be used to later support new anchors. The only components removed when the faulty wire assembly is removed are the anchors (with locators) and the wire electrode. The flexible supports make it much easier to remove the faulty wire assembly than in the prior art. The locators prevent the anchors from rotating after being installed into the housing.

A dicorotron ("Dicor") unit used is provided with a configuration having an open upper surface thereby forming a U-shaped housing for containing a wire assembly. The two side portions at each end of the dicor unit have slots or apertures therein, each side aperture in alignment with the apertures on the opposite side. In one embodiment a flexible gripper or interface is located at each of said ends and has tabs that snap into these apertures to hold these grippers in position. The anchors (or insulators) that hold the wire assembly in place are fitted into each of these flexible grippers. Thus, the wire assembly comprises a wire electrode strung between two anchors and locators attached to each anchor. This wire assembly represents the lesser expensive component when compared to the dicor unit or housing. Therefore, it is economically desirable when the wire assembly burns out, to replace only it rather than the entire dicor unit.

Today's copiers, printers and duplicators, as above noted, in many instances use several dicor units, especially in high speed or color copiers. One or more non-functional or burned out dicor units will disrupt the entire system. It is, therefore, important that all dicorotron units or dicor units be kept functional and are able to be easily removed and replaced. Prior to the present invention, wire assemblies were attached to dicor units via grippers that are fixed to the anchors and removably located on or to the sides of the dicor unit or housing. When removing a faulty wire assembly, the anchors of the wire assembly are dislodged from the dicor unit with the fixed grippers by prying them loose with a prying tool or lever.

In one embodiment of the present invention, a wire assembly of a dicorotron unit, is strung between the two insulator anchors which are removably attached to flexible interface grippers. The flexible interface grippers are adapted to hold each anchor in place and to provide easy removal of the anchors therefrom. The anchors are enabled to be removed easily and inserted into the flexible interface grippers. The interface grippers have a configuration that will provide a tight fit for anchors with locators that are provided therein. The interface grippers comprise snap tabs on an outer surface of said grippers. The tabs, as noted, are enabled to snap into apertures in the dicorotron unit or housing. The flexible interface grippers have an elongated configuration adapted to house the entire cylindrical anchors with their locators. The grippers have upwardly extending flexible supports, which are enabled to receive and hold said anchors in place, and to easily release them in a removal operation.

To summarize this embodiment, the interface grippers comprise upwardly extending flexible supports, and adjacent said flexible supports are flexible tabs. The tabs are enabled to snap into apertures in the dicorotron unit to thereby hold the grippers in place. The electrode wire is attached to and strung between two insulator anchors, the insulator anchors with locators are movably attached to the grippers. The interface grippers comprise a configuration adapted to receive and hold a cylindrical anchor. The grippers comprise in operative combination upwardly extending flexible supports which are enabled to mate with and hold locators which encircle the anchors. Located on outer surfaces of the grippers are flexible tabs which are adapted to snap into apertures in the dicorotron unit to thereby hold the grippers in position. This arrangement allows the anchors to be very easily removed from and inserted into the flexible interface grippers. The tabs are located on the grippers in a manner whereby they will align with the apertures and will be attached to the dicorotron unit when snapped into the apertures or slots. The anchors and locators will fit into the upwardly extending flexible supports. The upwardly extending supports are connected by a base section on which the anchors rest when removably fitted into the grippers. The locators have an inner curved portion that at least partially encircles the anchors and has an outer squared portion that contacts the grippers. With this configuration, the locators hold the anchors in position and prevent rotation of the anchors in the grippers.

Embodiments of the present invention comprise both a novel wire assembly and a novel dicorotron unit comprising this wire assembly.

In a dicorotron embodiment the dicorotron unit comprises the earlier defined wire assembly with the flexible grippers. The dicorotron unit has at its end portions at least two apertures. The wire assembly comprises an electrode wire and two insulator anchors, and locators encircling each anchor. The electrode wire is strung between the two anchors. The anchors are removably attached to the flexible upward supports of the interface grippers. The grippers have tabs which are enabled to snap into the apertures to hold the grippers in position in the dicorotron unit. The flexible grippers are adapted to hold the two anchors (located on each end of the dicorotron unit) and adapted to easily release the anchors upon the anchors being dislodged therefrom.

In the dicorotron unit the anchors are enabled to be inserted into the grippers and enabled to be deposited and removed from the flexible grippers in wire assembly insertion and removal operations.

The grippers have an elongated configuration adapted to house substantially the entire cylindrical anchor. Also, as above noted, the grippers have upwardly extending flexible supports which are enabled to receive and hold the anchors in place in the dicorotron unit. These grippers comprise upwardly extending flexible supports. Located next to these supports are tabs. These tabs are enabled to snap into the apertures at each end of the dicorotron unit to thereby hold the grippers in place. The dicorotron unit contains anchors which have locators or features that partially encircle the anchors. These features on their outer squared portion are adapted to fit against the upwardly extending supports when the anchors are fitted into the grippers. The locators at least partially encircle the anchors by their inner curved portion. As above noted, the grippers are in operative alignment with the apertures in the dicorotron unit, the tabs adjacent to the upwardly extending flexible supports.

DETAILED DESCRIPTION OF THE DRAWINGS AND PREFERRED EMBODIMENTS

Figure 1:
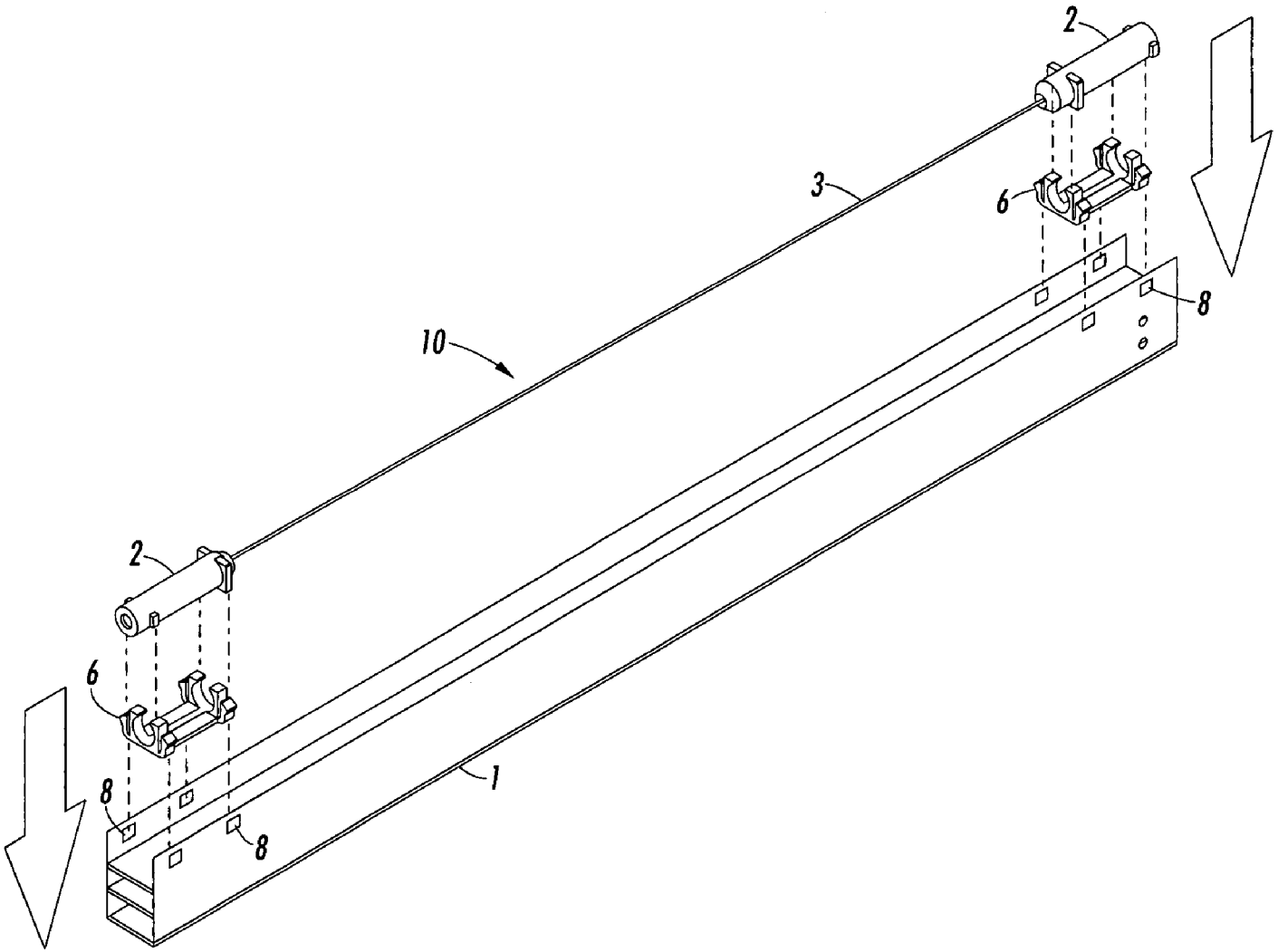
FIG. 1 illustrates an exploded view of the components of a dicorotron unit and the wire assembly of an embodiment of this invention.
Figure 2:
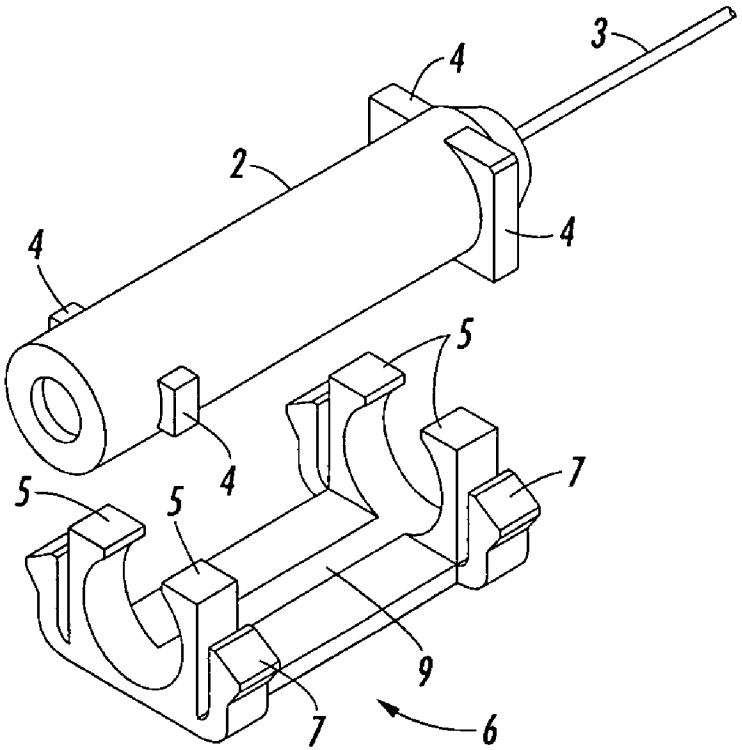
FIG. 2 illustrates an exploded view of an embodiment of the anchor and gripper of this invention whereby the components are disconnected.

In FIG. 1 the components of a dicorotron unit in an embodiment of this invention comprises a dicorotron housing 1, a wire assembly made up of a set of anchors 2 attached to the ends of a glass coated wire electrode 3. In FIG. 2, the anchors 2 have encircling at least a portion of their circumference, locators 4. These locators 4 will provide together with upwardly extending supports 5 a tight fit when anchors 2 are inserted into grippers 6 and will prevent rotation of the anchors 2. In an embodiment, the anchors 2 have two locators 4 attached thereto. The front locator 4 (nearest the wire electrode 3) is larger than the back locator 4. Both locators 4 are squared to prevent rotation of the anchor 2 when installed. On the outer surfaces of gripper 6 are locating tabs 7 that will snap into apertures or slots 8 (FIG. 1), which are located in the dicorotron housing 1. When grippers 6 are positioned in the dicorotron housing 1, tabs 7 are inserted into slots or apertures 8, providing a nest for anchors 2 to rest in. When gripper 6 is fixed into dicor housing 1, the end sections of gripper 6 provide upwardly extending flexible supports 5 in a somewhat c-like configuration, with flexible open tops so anchors 2 can be pushed therein. The wire assembly then comprises in operative relationship a wire electrode 3, two insulator anchors 2 and locators 4 which are connected to the anchor 2. The grippers have tabs 7, which as above noted, will fit in the slots 8 in the dicorotron housing 1. The grippers 6 have a configuration that is enabled to receive and hold cylindrical anchors 2 and with locators 4 prevent rotation of the anchors 2. The anchors 2 are held on their circular side sections by flexible supports 5 and are held and rest on their bottom sections over gripper floor 9. While tabs 7 can be on any suitable section of the grippers 6, in the embodiment illustrated in FIGS. 1–3, they are located on end portions of the gripper 6 adjacent to the upwardly extending flexible supports 5.

Figure 3:
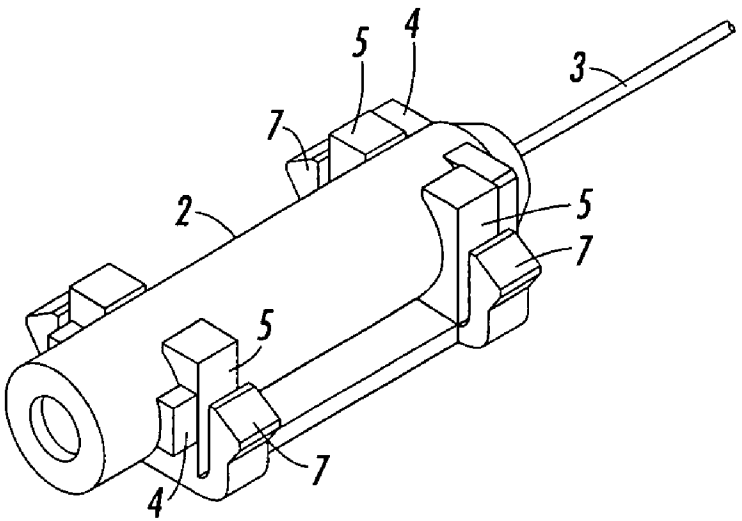
FIG. 3 illustrates an embodiment of the anchor and gripper whereby the anchor is fixed in and rests in the flexible, upward supports of the interface gripper.

In FIGS. 1, 2 and 3 the components of the wire assembly and grippers 6 disclosed and claimed herein are shown in enlarged presentations of FIGS. 2 and 3. The components of the wire assembly are wire electrode 3, anchors 2, with locators 4. In FIGS. 2 and 3, only one side of the wire assembly 10; anchors 2 and grippers 6 are shown. Obviously, as shown in FIG. 1, the anchors 2 and grippers 6 are located in each end of dicor housing or unit 1. Grippers 6 comprise in operative arrangement, a gripper floor 9, two upward facing C-shaped flexible supports 5 and tabs 7. These tabs 7 will fit into slots or apertures 8 in the end portions of dicorotron housing 1. When the anchors 2 are inserted into grippers 6, the locators 4 fit tightly against upward flexible supports 5 to removably hold the anchors 2 in place. Then the tabs 7 are snapped into the dicor housing 1 to secure the grippers 6 in place. To remove a faulty wire assembly 10, anchors 2 can be easily dislodged from flexible gripper supports 5 and removed from housing 1. A new wire assembly 10 can then easily replace an old and faulty wire assembly 10. Any suitable means can be used to remove the old wire assembly 10 and replace it with a new wire assembly 10.

Figure 4:
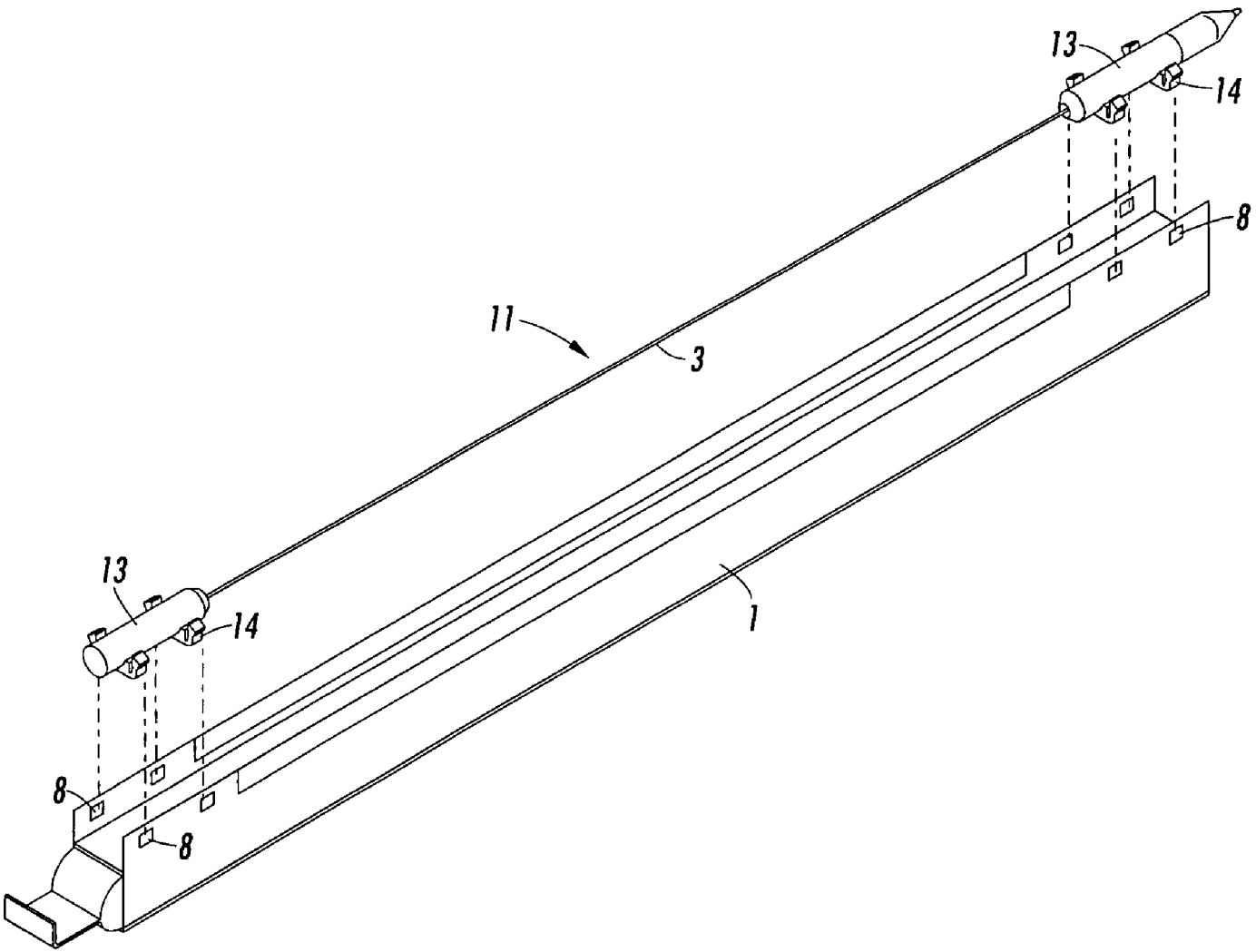
FIG. 4 PRIOR ART
FIG. 4 illustrates the wire assembly of a typical prior art dicorotron unit where the grippers are permanently attached to the anchors.

FIG. 4 illustrates a prior art wire assembly 11 as it is removed from a dicorotron unit or housing 1. The prior art anchors 13 are secured in and are removed with grippers 14. It is much more difficult to remove the wire assembly 11 with attached grippers 14 from the dicorotron unit 1 because of the grippers 14 being one with the anchors 13. Also, it is much more convenient and easier if as in the present embodiments, the wire assembly 10 can be removed from the flexible grippers 6 and housing 1 without the necessity of also removing prior art grippers 14.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A dicorotron unit adapted for use in an electrostatic copying process, said dicorotron unit comprising a housing and a wire assembly, said dicorotron unit comprising at end portions of said housing at least two apertures, said wire assembly comprising an electrode wire, two insulator anchors and locators attached to said anchors, said electrode wire strung between said two anchors, said anchors are removably attached to flexible interface grippers, said grippers having tabs which are enabled to snap into said at least one slot to hold said grippers in position in said dicorotron unit, said grippers adapted to hold two said anchors and adapted to release said anchors upon said anchors being dislodged therefrom, said grippers enabled to remain in said dicorotron unit upon release of said anchors therefrom, said locators adapted to prevent rotation of said anchor in said gripper, said locators having an inner curved portion that contacts said anchors and an outer squared portion that contacts said grippers, and wherein said grippers have an elongated configuration adapted to house substantially the entire anchor.

2. The dicorotron unit of claim 1 wherein said anchors are enabled to be inserted into said grippers and enabled to be removed from said grippers in an anchor insertion and removal operation, and wherein said grippers remain in said dicorotron unit after said removal operation.

3. The dicorotron unit of claim 1 wherein said grippers have upwardly extending flexible supports which fit against said locators and are enabled to receive and hold said anchors in place in said dicorotron unit.

4. The dicorotron unit of claim 1 wherein said grippers comprise upwardly extending flexible supports, and adjacent said supports are located tabs, said tabs enabled to snap into said slots to thereby hold said grippers in place.

5. The wire assembly of claim 1 whereby said anchors are enabled to be easily removed and inserted into said flexible interface grippers while said grippers remain in said dicorotron unit.

6. The wire assembly of claim 1 whereby said locators are adapted to prevent rotation of said anchors when in said grippers, said locators having an inner curved portion that contacts said anchors and an outer squared portion that contacts said grippers.

7. The wire assembly of claim 1 whereby said anchors are adapted to rest in said upwardly extending supports and are easily removed from said supports leaving said grippers in said dicorotron after removal of said wire assembly.

8. A dicorotron unit adapted for use in an electrostatic copying process, said dicorotron unit comprising a housing and a wire assembly, said dicorotron unit comprising at end portions of said housing at least two apertures, said wire assembly comprising an electrode wire, two insulator anchors and locators attached to said anchors, said electrode wire strung between said two anchors, said anchors are removably attached to flexible interface grippers, said grippers having tabs which are enabled to snap into said at least one slot to hold said grippers in position in said dicorotron unit, said grippers adapted to hold two said anchors and adapted to release said anchors upon said anchors being dislodged therefrom, said grippers enabled to remain in said dicorotron unit upon release of said anchors therefrom, said locators adapted to prevent rotation of said anchor in said gripper, said locators having an inner curved portion that contacts said anchors and an outer squared portion that contacts said grippers, and wherein said grippers have an elongated configuration comprising a base section and upwardly extending from said base section are flexible supports which hold said anchors in place over said base section and which cooperate with said locators to prevent unintentional movement of said anchors.

9. The wire assembly of claim 8 whereby said anchors are enabled to be easily removed and inserted into said flexible interface grippers.

10. The wire assembly of claim 8 whereby said locators are adapted to prevent rotation of said anchors when in said grippers, said locators having an inner curved portion that contacts said anchors and an outer squared portion that contacts said grippers.

11. The wire assembly of claim 8 whereby said anchors are adapted to rest in said upwardly extending supports and are easily removed from said supports leaving said grippers in said dicorotron after removal of said wire assembly.

* * * * *

UNITED STATES PATENT AND TRADEMARK OFFICE

CERTIFICATE OF CORRECTION

PATENT NO. : 7,208,732 B2
APPLICATION NO. : 11/235937
DATED : April 24, 2007
INVENTOR(S) : Jamie S. Clayfield and S. Chad Velk It is certified that error appears in the above-identified patent and that said Letters Patent is hereby corrected as shown below:

Title page, item [73] ASSIGNEE: should read as follows:

XEROX CORPORATION
800 LONG RIDGE RD.
STAMFORD, CT 06904-1600

Signed and Sealed this

Twenty-third Day of September, 2008

JON W. DUDAS
*Director of the United States Patent and Trademark Office*